US005704775A

United States Patent [19]

Gilbert

[11] Patent Number: 5,704,775

[45] Date of Patent: Jan. 6, 1998

[54] AUXILIARY IGNITER AND CONTROL FOR A FURNACE

[76] Inventor: Paul A. Gilbert, 19830 Rocking Horse Rd., Bend, Oreg. 97708

[21] Appl. No.: 623,358

[22] Filed: Mar. 28, 1996

[51] Int. Cl.[6] ..... F23N 5/00

[52] U.S. Cl. ..... 431/66; 431/13; 431/43; 431/74

[58] Field of Search ..... 431/66, 67, 77, 431/74, 13.6, 18, 28, 263, 264, 258, 43, 254–257; 126/39 BA, 42, 39 E

[56] References Cited

U.S. PATENT DOCUMENTS

| | | | |
|---|---|---|---|
| 2,444,239 | 6/1948 | Aubert et al. | 431/66 |
| 3,209,809 | 10/1965 | Nielsen et al. | 431/66 |
| 3,502,419 | 3/1970 | Perl | 431/66 |
| 3,547,592 | 12/1970 | Gladu et al. | 431/258 |
| 3,600,119 | 8/1971 | Abbott, Jr. | 431/263 |
| 3,663,150 | 5/1972 | Hapgood | 431/66 |
| 5,472,336 | 12/1995 | Adams et al. | 431/25 |

*Primary Examiner*—James C. Yeung
*Attorney, Agent, or Firm*—Robert L. Harrington

[57] ABSTRACT

A furnace for combustible fuels that incorporates a main igniter and an auxiliary back-up igniter for igniting the fuel. When power is applied to the main igniter, a sensor detects whether or not current flows through the main igniter. If there is current flow through the main igniter, the back-up igniter is isolated from the input power. If there is an absence of current flow through the main igniter, the power is switched to the auxiliary back-up igniter. A warning device is provided to alert a user when the power has been switched to the back-up igniter indicating that the main igniter is inoperable.

7 Claims, 3 Drawing Sheets

AUXILIARY IGNITER AND CONTROL FOR A FURNACE

FIELD OF THE INVENTION

This invention relates to igniters for furnaces and more particularly to an auxiliary back-up igniter and control.

BACKGROUND INFORMATION

Modern fuel burning furnaces are automatically controlled. When there is a demand for heat, the furnace is arranged to automatically turn the fuel on, ignite the fuel and burn the fuel until a desired temperature range has been reached. The furnace will then shut off the fuel supply waiting until the next demand for heat arises.

The type of furnace contemplated herein utilizes a hot surface igniter to ignite the fuel when there is a demand for heat. Typically a thermostat in a room or an area serviced by the furnace is used to control the operation of the furnace. The thermostat will detect when the temperature has dropped to a level such that more heat is required. The thermostat will send a signal to the control of the furnace and the control in turn will apply electrical power to the hot surface igniter to elevate the temperature of the igniter to a sufficient temperature to ignite the fuel. When the igniter has been elevated to the ignition temperature, the control opens a fuel valve to dispense fuel to a burner unit and the fuel is ignited. Typically a sensor such as a flame sensor placed strategic to the burner unit is provided to confirm that ignition of the fuel has occurred and that combustion is maintained. The flame sensor will send a signal to the control unit that the fuel is burning. The control will then turn the power to the igniter off. The furnace will continue burning the fuel until the thermostat sends a signal to the control that the desired temperature in the room has been reached. The control will then close the fuel valve.

The furnace functions well as long as the fuel igniter is operable. Should the igniter fail for any reason, the fuel will not be ignited and, therefore, heat will not be supplied to the room or area served by the furnace. This can bring about disastrous results for a user. People that live in cold climates where the temperature drops well below the freezing point of water often leave their dwellings for short trips or extended vacations. Rather than drain all of the water pipes and related equipment, the people will generally leave the dwelling with heat on. That is, the thermostat may be turned down but the temperature will be maintained well above the freezing point. Should the igniter fail, the furnace, of course, will be inoperative and heat will not be supplied to the dwelling. Should the temperature drop below the freezing point, it is likely that the water pipes will freeze and burst causing flooding and other damage to the dwelling. Additionally, the homeowners generally have plants and other items that will not withstand freezing temperatures.

Whereas furnace igniters have been designed to last for years of reliable operation, and whereas numerous safety features prevent most kinds of furnace malfunction (e.g., for turning the fuel off if burning of the fuel is not detected), the fact is that furnace igniters do become inoperative. The heat generated by the igniter is intense (e.g., 3,400 degrees Fahrenheit) and over time can cause a fracture rendering the igniter inoperative. The present invention overcomes the problem of igniter malfunction by providing a back-up igniter.

BRIEF SUMMARY OF THE INVENTION

A preferred embodiment of the present invention is a furnace that has both a main igniter and an auxiliary back-up igniter. The auxiliary back-up igniter is not utilized or put into operation unless the main igniter fails. The main and the auxiliary back-up igniter are hot surface type igniters. Electrical power or current flow is applied to the igniter and the resistance of the igniter will elevate the temperature of the igniter to such a degree that the fuel will be readily ignited. As explained, over time the main igniter may fail, e.g., due to the intense heat, whereas the auxiliary igniter is not in use and not subject to heat deterioration and is thus available to take over ignition when the main igniter fails.

A sensor is provided to detect current flow to the main igniter, i.e., when the control calls for heat. As long as current is detected for the main igniter, no current is applied to auxiliary back-up igniter. When the sensor does not detect current flow through the main igniter, current flow redirected by the control to the auxiliary back-up igniter and thus the fuel is ignited by the back-up igniter.

When the main igniter fails and the auxiliary second igniter is utilized, a signal is sent to a warning indicator that will alert the homeowner or care taker that the main igniter has failed and requires igniter replacement even though the furnace is otherwise functioning as before.

Refer now to the drawings and the detailed description which follows for a complete understanding of the invention.

DESCRIPTION OF THE PREFERRED EMBODIMENT

Figure 1:
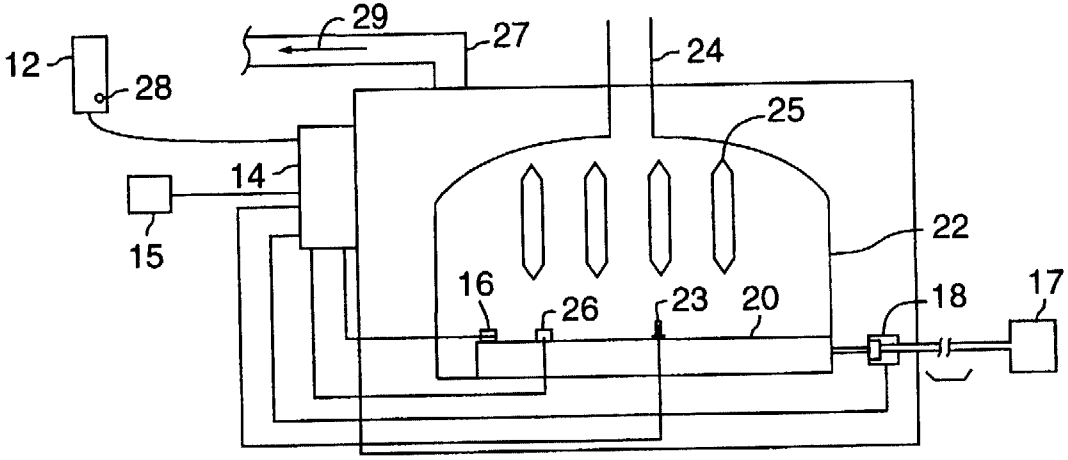
FIG. 1 is a schematic view of a furnace incorporating the auxiliary back-up igniter and control of the present invention.

FIG. 1 schematically illustrates a furnace that incorporates the present invention. The furnace is of the type that is automatically controlled and will burn a combustible fuel only when the demand for heat is required. An adjustable thermostat 12 is provided to provide a signal to the furnace when heat is required. The thermostat 12 is of the known type and is adjustable to adjust the desired temperature in a room or area that the furnace will service. The thermostat 12 will send a signal to a control unit 14 when the temperature in the area or room whereat the thermostat is mounted drops below a preset level and the heating cycle is initiated. The thermostat 12 will also send a signal to the control unit 14 when the desired temperature in the room has been reached and the heating cycle is discontinued.

The furnace has a burner 20 contained within a combustion chamber 22 of the furnace. The combustion chamber 22 has a stack 24 for the escape of the air and gases as a result of the combustion of the combustible fuel. A sensor such as a flame sensor 23 coupled to the control 14 is provided strategic to the burner 20 to confirm ignition and the sustained combustion of the fuel. Typically the furnace will have a fan (not illustrated) that will create a negative air pressure within the chamber 22 and a pressure switch which will confirm the presence of the negative air pressure in the combustion chamber 22. These items are well known in the art and are not part of the present invention and, therefore, are not detailed.

In this embodiment, the furnace has a conventional plenum 25 through which air is heated and circulated to the room or area serviced when there is a demand for heat. The air is delivered to the room or area by a duct 27 as indicated by arrow 29 by known air circulating methods.

The above is an example of one arrangement of a furnace. It will be appreciated that the thermostat 12 may be located in or on other devices such as a water boiler. In any event the furnace is operable to burn a combustible fuel (to provide heat) only when there is a demand for heat.

A main igniter 16 and an auxiliary igniter 26 are mounted strategic to the burner 20 in the chamber 22 and are electrically coupled to the control 14. The igniters 16 and 26 are of the hot surface type, that is, when electrical power is applied to the igniters they will heat up due to their resistance.

The control unit 14 is of the type that controls the transmission of electrical power from a power source 15 to the main igniter 16 (and alternatively will supply power to an auxiliary igniter 26 when the main igniter 16 has failed) when there is a demand for heat. When the main igniter 16 (or alternatively the auxiliary back-up igniter 26) has reached an elevated temperature, the control 14 will open a valve unit 18 to allow the flow of a combustible fuel from a combustible fuel source (indicated at 17) to the burner 20.

The control unit 14 includes a sensing circuit to sense current flow to the main igniter 16 when voltage is being applied to the main igniter 16, i.e., when heat has been called for and the control initiates heating of the main igniter 16. The sensing circuit thus confirms whether or not the main igniter 16 is operating. Should the main igniter 16 have an open circuit which establishes that it is not operating, i.e., that it has ruptured or been otherwise rendered inoperative, the control unit 14 will immediately switch over to the auxiliary back-up igniter 26. The back-up igniter 26 when it is activated will be elevated in temperature to ignite the fuel presented to the burner 20.

When the control unit 14 switches the power to the back-up igniter 26 due to the failure of the main igniter 16, the control unit 14 also includes circuitry to activate a warning indicator 28. In this embodiment, the warning indicator 28 is provided on the thermostat 12 and is in the form of an illuminated unit such as a light emitting diode. The warning indicator 28 is arranged to remain activated, that is, in a lit condition until a reset button is pushed. The warning indicator 28 will alert the homeowner or any occupant of the premises that the main igniter 16 has failed and is due for replacement.

Figure 2:
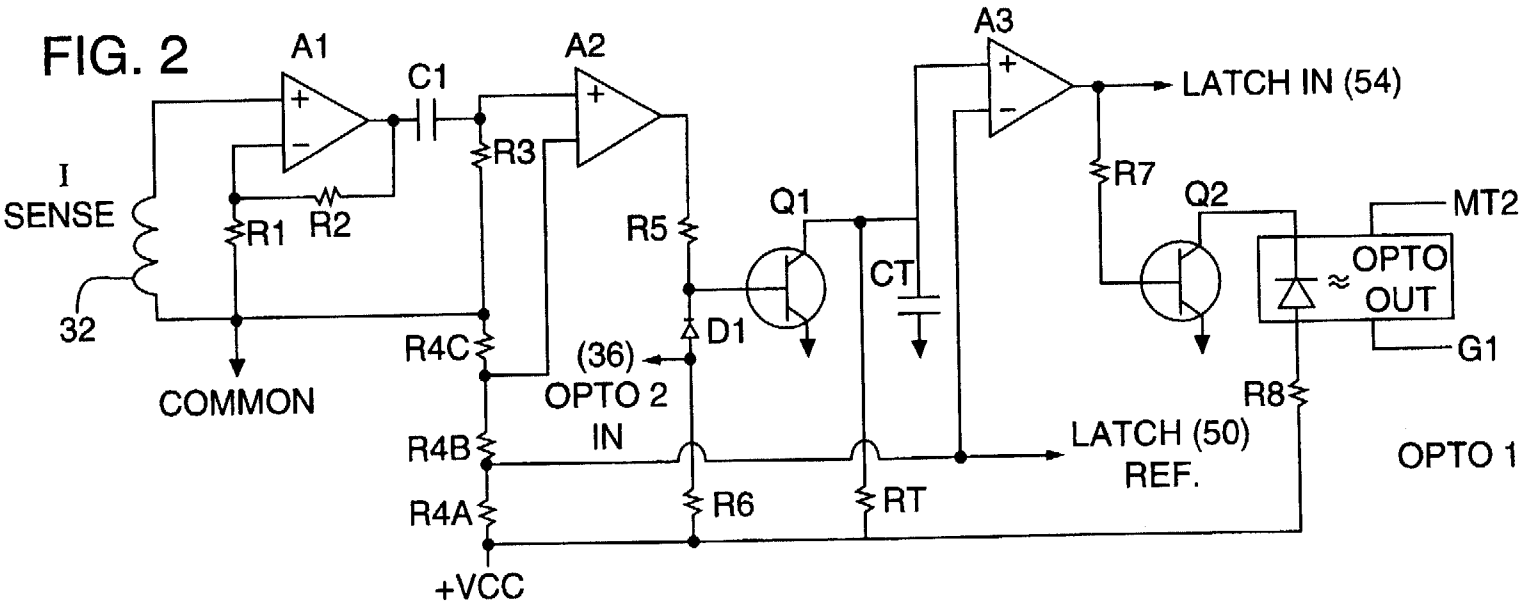
FIG. 2 is a schematic view of a sensing circuit.
Figure 3:
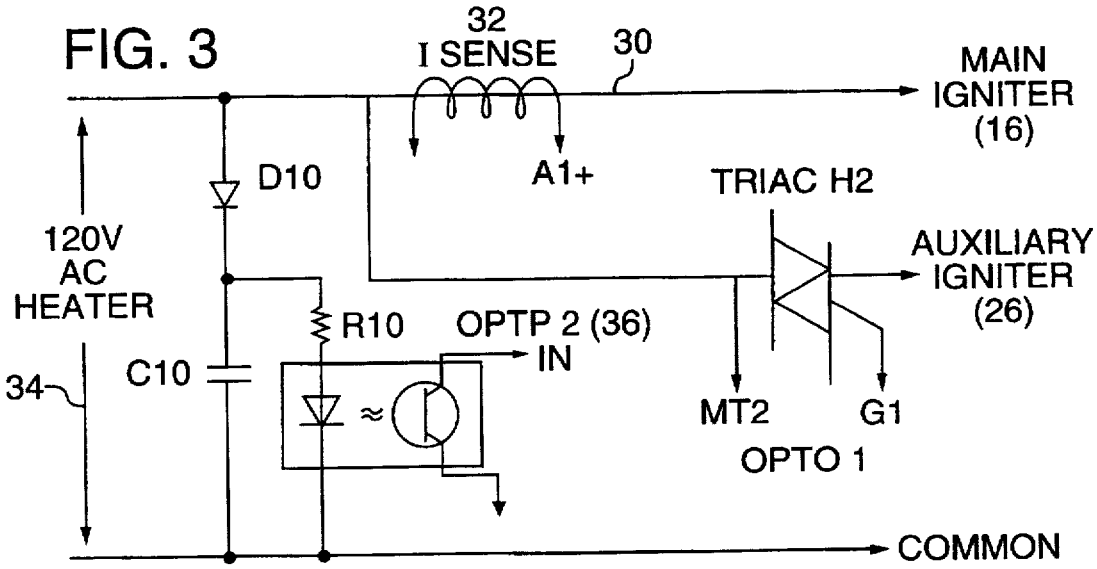
FIG. 3 is a schematic view of the sensing circuit of FIG. 1 and a switching control.

Refer now to FIGS. 2 and 3 (and the explanation which follows) which sets forth a specific example of the circuitry in the control unit 14 for sensing the presence of current in the main igniter 16 and in absence thereof, for diverting current to the back-up igniter. When there is a demand for heat, the control unit 14 in normal operation applies a voltage 34 (FIG. 3) to the main igniter 16. In this embodiment, the input voltage 34 is 120V AC. The diode D10 and capacitor C10 (FIG. 3) convert the input 120V AC into approximately 150V DC. This 150V DC is applied to OPTO 2 through the limiting resister R10. The output (36) of OPTO 2 is used to connect the junction of D1 and R6 to common (FIG. 2). This circuitry is activated whenever voltage is applied to the main igniter 16 by the control unit 14 whether the igniter 16 is functional or not. This action prepares the control circuitry to detect the presence or absence of current flow through the main igniter 16.

Figure 4:
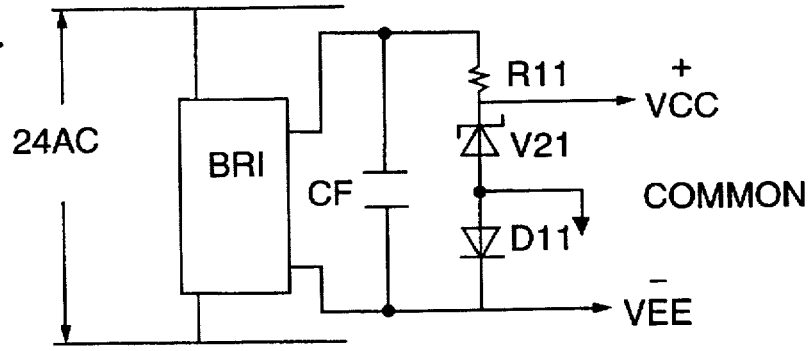
FIG. 4 is a schematic view of a power supply utilized in the furnace of FIG. 1.

The control unit 14 in this embodiment has a continuous 24V AC source as shown in FIG. 4. The 24V AC is converted to DC through bridge rectifier BR1 and filter capacitor CF. The zener diode AD1 establishes the level of Vcc+ at some arbitrary level, usually 5–10 volts. Diode D11 sets the level of Vee- at about –0.8V. DC. These voltages are referenced to common. The resister R11 limits the overall maximum current to about 50 milliamps. Vcc, Vee, and common are provided for the proper amplifier action. The continuous 24V source also supplies power for the optional warning indicator 28 when activated to maintain the indicator 28 in a lit condition.

In response to a demand for heat, the control unit 14 applies power to the main igniter 16 through line 30 (FIG. 3). When current flows through the main igniter 16, a voltage is induced in the inductor 32 (Isense) and this voltage is applied to and amplified by the amplifier A1 (FIG. 1). The overall gain of A1 is established by the ratio of the resisters R2 and R1. A capacitor C1 is provided to block any DC level present in A1 from effecting the amplifier/discriminator A2. The amplifier/discriminator A2 is normally locked in the low state by a small positive voltage applied to the negative input. The amplitude of this small positive voltage is set by the specific values of the resisters R4A, R4B and R4C. The amplifier/discriminator A2 will conduct only when an alternating current signal is present from amplifier A1 which exceeds the preset level of the small positive voltage applied to the negative input. When an AC signal that exceeds the discriminator level (preset) is present, A2 conducts and A2's output goes full positive and full negative, converting the amplified signal into a square wave. This action alternately turns driver Q1 on and off.

When AC voltage is applied to the main igniter 16 by the control unit 14, the output of OPTO 2 (36) connects the junction of the diode D1 and resister R6 to common. Driver Q1 is turned off, and if no signal is present from amplifier A2, the combination of resister RT and capacitor CT begins to charge toward plus Vcc. At some point in this charge cycle, the voltage on the capacitor CT will exceed the voltage latch reference on the negative input. When this occurs, the output of amplifier A3 (FIG. 2) goes high and turns on driver Q2 through limiting resister R7. Driver Q2 conducts current through OPTO 1 and limiting resister RS. Two outputs of OPTO 1 (MT2 and G1) are used to turn on the triac H2 (FIG. 3). The triac H2 when turned on will supply power to the auxiliary back-up igniter 26 from the applied power 34 (FIG. 3).

When current is present in the main igniter 16, the signal from amplifier A2 alternately turns driver Q1 off and on, discharging capacitor CT before it has a chance to turn A3 on and the amplifier/comparator A3 remains in the low state. Thus, if current is detected in the main igniter 16, the driver Q2 is not turned on and thus the triac H2 remains in the off position which isolates the back-up igniter 26.

Figure 5:
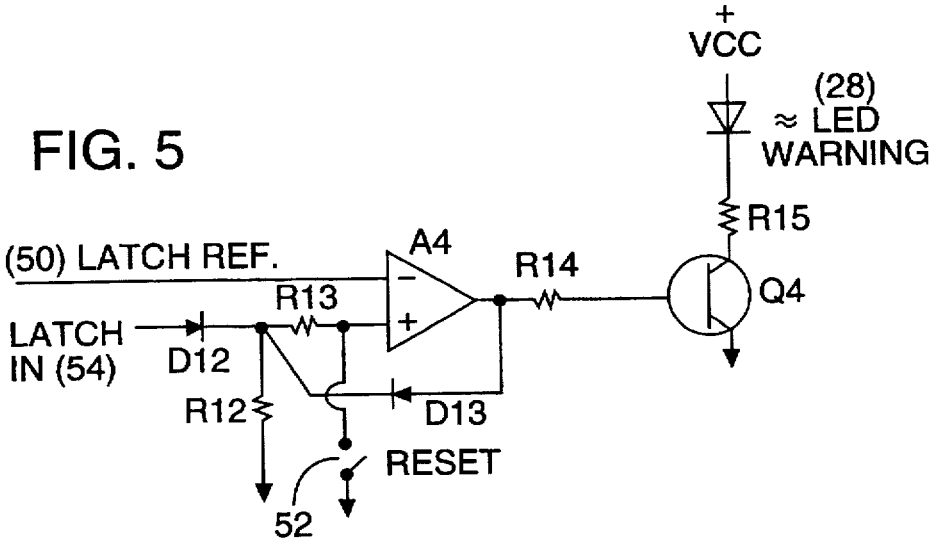
FIG. 5 is a schematic view of a latching circuit and warning device.

FIG. 5 illustrates the circuitry for the optional warning indicator 28. The circuitry and the indicator 28 is provided when it is desired to have a visual indication that the main igniter 16 has failed (or is inoperative due to other causes) and that the furnace 10 is operating on the back-up igniter 26. The amplifier A4 of FIG. 5 is configured as a comparator, with the latch reference 50 (FIG. 2) connected to the negative input. The latch-in 54 is connected to the diode D12. This causes the amplifier A4 to be locked in the low output state, and the driver Q4 is turned off. When the output of amplifier A3 (FIG. 2) goes high, which indicates that there is no current flowing through the main igniter 16, voltage on D12 exceeds the latch reference 50 and the output of the amplifier A4 goes high. This action feeds back a high voltage to the positive input of the amplifier A4 through diode D13. The amplifier A4 latches in the on state and stays there until the reset 52 is activated. When the output of amplifier A4 goes high, driver Q4 is turned on through limiting resister R14. Driver Q4 conducts through limiting resister R15 and the light emitting diode 28. Once activated, the light emitting diode 28 stays on until the reset switch 52 is closed even if power (34) is removed from the igniter.

Figure 6:
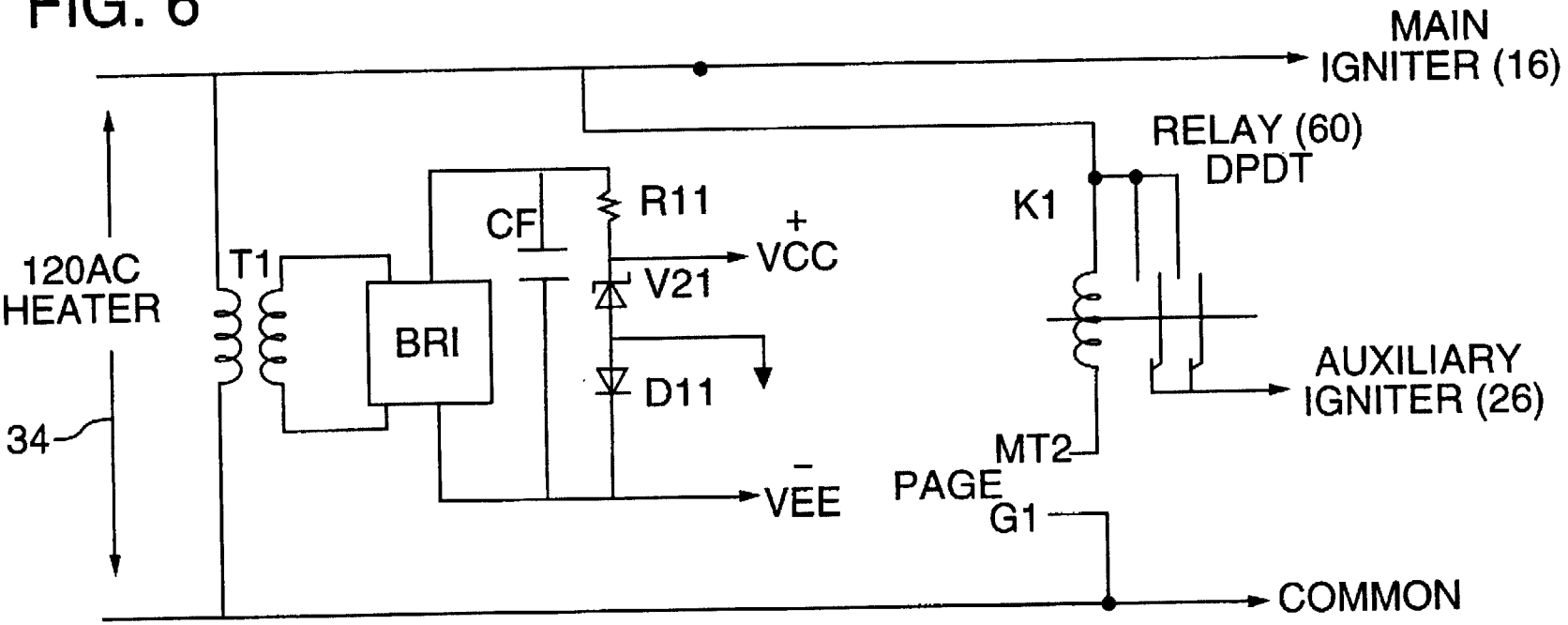
FIG. 6 is a schematic view of an alternate power supply and relay.

When the control unit 14 does not include a 24V AC power supply, an alternate supply is utilized as indicated in FIG. 6. Transformer T1 converts the voltage 34 applied to the igniter 16 to a more usable level, anywhere from about 6–24V AC. Bridge rectifier BR1 and the filter capacitor CF convert this AC voltage to DC voltage. The zener diode VZ1 establishes the level of Vcc+ at some arbitrary level, usually 5–10 volts. The diode D11 sets the level of Vee- at about –0.8V DC. These voltages are referenced common. The resister R11 limits the overall maximum current to about 50 milliamps. As with the 24V AC power supply, the alternate power supply provides Dcc, Vee, and common for proper amplifier action. Since the alternate power supply is only functional when the voltage 34 is applied to the main igniter 16, the OPTO 2 circuit (FIG. 3) and the diode D1 and resister R6 (FIG. 2) are eliminated.

A relay 60 may be utilized to supply power to the auxiliary back-up igniter 26 instead of the triac H2. The relay is illustrated in FIG. 6 and in this embodiment the relay 60 is of the double pole, double throw type. The poles of the relay 60 are wired in parallel for increased current handling ability. The relay 60 is closed when driver Q2 conducts current through OPTO 1 and limiting resister RS. The two outputs of OPTO 1 (MT2 and G1) are used to close the relay 60 to apply power to the auxiliary back-up igniter 26.

The control 14 of the furnace 10 will thus automatically switch power to the auxiliary back-up igniter 26 in the event current does not flow through the main igniter 16. The warning indicator 28 will provide a visual indicator that the main igniter 16 is inoperable and that the furnace 10 is operating on the auxiliary back-up igniter 16.

Those skilled in the art will appreciate that variations and modifications may be made without departing from the true spirit and scope of the invention. The invention is, therefore, not to be limited to the embodiments described and illustrated but is to be determined from the appended claims.

What is claimed is:

1. A combustible fuel furnace having a burner in a combustion chamber, comprising:

a main fuel igniter positioned strategic to the burner;

an auxiliary back-up igniter positioned strategic to the burner;

a control unit;

an electrical power source providing electrical power;

said control unit controlling the application of the electrical power from the power source to the main igniter;

a sensor detecting whether current is flowing through the main igniter when the control applies power to the main igniter;

said control responsive to the sensor not detecting current flow through the main igniter for switching the power applied to the main igniter to the auxiliary back-up igniter.

2. A furnace as defined in claim 1 including:

an electrically activated signal connected to said control;

said control directing electrical power to said signal upon switching electrical power from said main igniter to the back-up igniter.

3. A furnace as defined in claim 2 wherein the furnace is installed in a household having an occupant, a thermostat in the household accessible to the occupant is connected to the control and signals the control to initiate combustion according to a setting of the thermostat, said electrically actuated signal mounted on the thermostat.

4. A combustible fuel furnace as defined in claim 3 wherein the electrically actuated signal is a light.

5. A combustible fuel furnace as defined in claim 1 wherein a fuel source to the combustion chamber is controlled by the control unit.

6. A combustible fuel furnace as defined in claim 5 wherein said main igniter and said back-up igniter are hot surface type igniters.

7. A system for assuring ignition of a combustible fuel furnace comprising:

a combustion chamber;

a main igniter in the combustion chamber responsive to electrical power for igniting fuel supplied to the combustion chamber;

a fuel source providing fuel to the combustion chamber, and a valve controlling the flow of fuel to the combustion chamber, and a heat duct conveying heated air from the combustion chamber;

a living area connected to the heat duct and receiving heat from said heat duct, and a thermostat in the living area;

a control connected to the thermostat and controlling the valve for fuel flow and igniter for igniting fuel, said control responsive to a heat demand signal of the thermostat to open the valve and provide fuel flow to the chamber and to provide electrical power to the main igniter for igniting the fuel and thereby generating the flow of heated air through the duct to the living area;

said control further including a sensor sensing the electrical power flow through the main igniter, a back-up igniter in the combustion chamber responsive to electrical power for igniting fuel supplied to the combustion chamber, and said control responsive to the sensor failing to detect electrical power flow through the main igniter to direct electrical power to the back-up igniter.

* * * * *